US007422386B2

(12) United States Patent
Ohmori et al.

(10) Patent No.: US 7,422,386 B2
(45) Date of Patent: Sep. 9, 2008

(54) IMAGE CREATION AND CUTTING APPARATUS

(75) Inventors: Hisao Ohmori, Shizuoka-ken (JP); Yuji Sakata, Shizuoka-ken (JP)

(73) Assignee: Roland DG Corporation, Hamamatsu-shi (JP)

( * ) Notice: Subject to any disclaimer, the term of this patent is extended or adjusted under 35 U.S.C. 154(b) by 237 days.

(21) Appl. No.: 11/121,672

(22) Filed: May 3, 2005

(65) Prior Publication Data

US 2006/0007292 A1 Jan. 12, 2006

(30) Foreign Application Priority Data

Jul. 7, 2004 (JP) ..... 2004-200904
Jul. 23, 2004 (JP) ..... 2004-215913

(51) Int. Cl.
*B41J 2/01* (2006.01)
*B41J 11/66* (2006.01)
*B41J 2/185* (2006.01)

(52) U.S. Cl. ..... 400/621; 347/29

(58) Field of Classification Search ..... None
See application file for complete search history.

(56) References Cited

U.S. PATENT DOCUMENTS 5,854,643 A * 12/1998 Katsuyama ..... 347/8
6,913,354 B2 * 7/2005 Rasmussen et al. ..... 347/102
7,121,750 B2 * 10/2006 Iwase et al. ..... 400/354

FOREIGN PATENT DOCUMENTS

GB 2295584 A * 6/1996
JP 09066698 A * 3/1997
JP 11138848 A * 5/1999
JP 2000301778 A * 10/2000
JP 2003136804 A * 5/2003

OTHER PUBLICATIONS

Machine translation of JP 11138848 to Miyazawa et al. from Japanese Patent Office website.*
Machine translation of JP 09066698 to Douo et al. from Japanese Patent Office website.*

* cited by examiner

*Primary Examiner*—Daniel J Colilla
(74) *Attorney, Agent, or Firm*—Lee, Hong, Degerman, Kang & Schmadeka

(57) ABSTRACT

A printer is disclosed for cutting-out a printed image on an item being processed while traveling in a first direction. The printer comprises a cutting head coupled for movement in a second direction, an ink head detachably coupled to the cutting head for movement in the second direction, and a fixed base for supporting the surface, wherein the first direction is perpendicular to the second direction.

29 Claims, 11 Drawing Sheets

IMAGE CREATION AND CUTTING APPARATUS

CROSS-REFERENCE TO RELATED APPLICATIONS

Pursuant to 35 U.S.C. § 119(a), this application claims the benefit of earlier filing date and right of priority to Japanese Application No. 2004-215913, filed on Jul. 23, 2004, and Japanese Application No. 2004-200904, filed on Jul. 7, 2004, the contents of which are hereby incorporated by reference herein in their entirety.

BACKGROUND OF THE INVENTION

1. Field of the Invention

The present invention relates to an image creation and cutting apparatus. More specifically, the present invention relates to a printer that prints an image on a concave or convex surface of an item to be processed. The printer provides a cutting head capable of disconnecting from a printing head for cutting-out the image.

2. Description of the Related Art

Various types of printing apparatuses are commercially available. One such printing apparatus is an ink jet printer. Conventionally, ink jet printers have an ink jet head for housing an ink nozzle wherein a cap is required to be placed over the ink nozzle to prevent a connected ink cartridge from drying out while the printer performs a non-printing function, such as a cutting operation. Also, a locking apparatus is required for securing the cap over the ink nozzle. The locking apparatus is placed over an end of the ink jet head along the same direction as the printer scans an item to be processed. A disadvantage of the conventional ink jet printer is that the locking apparatus increases the width of the ink jet head, thus limiting the ink jet head's maneuverability over the item being processed. Also, the addition of the locking apparatus increases the number of parts of the printer resulting in increased printer costs to a user.

Furthermore, although conventional ink jet printers are able to print an image, a separate cutting machine is required for cutting-out the image. Therefore, a need exists for a printer having integrated image printing and cutting capabilities for an item to be processed which provides advantages and improvements over the conventional printers.

SUMMARY OF THE INVENTION

Features and advantages of the invention will be set forth in the description that follows, and in part will be apparent from the description, or may be learned by practice of the invention. The objectives and other advantages of the invention will be realized and attained by the structure particularly pointed out in the written description and claims hereof as well as the appended drawings.

In one embodiment, a printer is disclosed for cutting-out a printed image on an item to be processed that is located on a surface traveling along a first direction. The printer comprises a cutting head coupled for movement in a second direction, an ink head detachably coupled to the cutting head for movement in the second direction, and a fixed base for supporting the surface, wherein the first direction is perpendicular to the second direction.

In another embodiment, a printer is disclosed for cutting-out a printed image on an item to be processed that is located on a surface traveling in a first direction. The printer comprises a belt conveyor for transporting an item to be processed in a first direction, and an ink head disposed for movement in a second direction perpendicular to the first direction. A cutting head is detachably coupled to the ink head. A sensor is provided for detecting a distance of the item to be processed from the ink nozzle and the cutting head while the item is transported along the belt conveyor.

In another embodiment, an apparatus is disclosed for creating an image on a sheet. The apparatus disclosed comprises means for moving the sheet along a first direction, and a cutting head having a cutter supported for movement on a guide rail disposed along a second direction for cutting the image from the sheet. An ink head is disposed on the guide rail and positioned on a side of the cutting head for creating the image on the sheet. The apparatus further comprises means for controlling movement of the cutting head and the ink head on the guide rail in response to the image data. A first connection means is disposed on a side of the cutting head, and a second connection means is disposed on a side of the ink head for detachably coupling with the first connection means.

Additional features and advantages of the invention will be set forth in the description, and in part will be apparent from the description, or may be learned by practice of the invention. It is to be understood that both the foregoing general description and the following detailed description of the present invention are exemplary and explanatory and are intended to provide further explanation of the invention as claimed.

These and other embodiments will also become readily apparent to those skilled in the art from the following detailed description of the embodiments having reference to the attached figures, the invention not being limited to any particular embodiments disclosed.

BRIEF DESCRIPTION OF THE DRAWINGS

The accompanying drawings, which are included to provide a further understanding of the invention and incorporated in and constitute a part of this specification, illustrate embodiments of the invention and together with the description serve to explain the principles of the invention.

Features, elements, and aspects of the invention that are referenced by the same numerals in different figures represent the same, equivalent, or similar features, elements, or aspects in accordance with one or more embodiments.

DETAILED DESCRIPTION OF THE PREFERRED EMBODIMENTS

The present invention relates to an image creation and cutting apparatus. More specifically, the present invention relates to a printer that prints an image on a concave or convex surface of an item to be processed and provides a cutting head for cutting-out the image.

Although the invention is illustrated with respect to an ink jet printer, the invention may be utilized wherever it is desired for a printer having integrated image creation and cutting capabilities. Reference will now be made in detail to the preferred embodiments of the present invention, examples of which are illustrated in the accompanying drawings.

Figure 1:
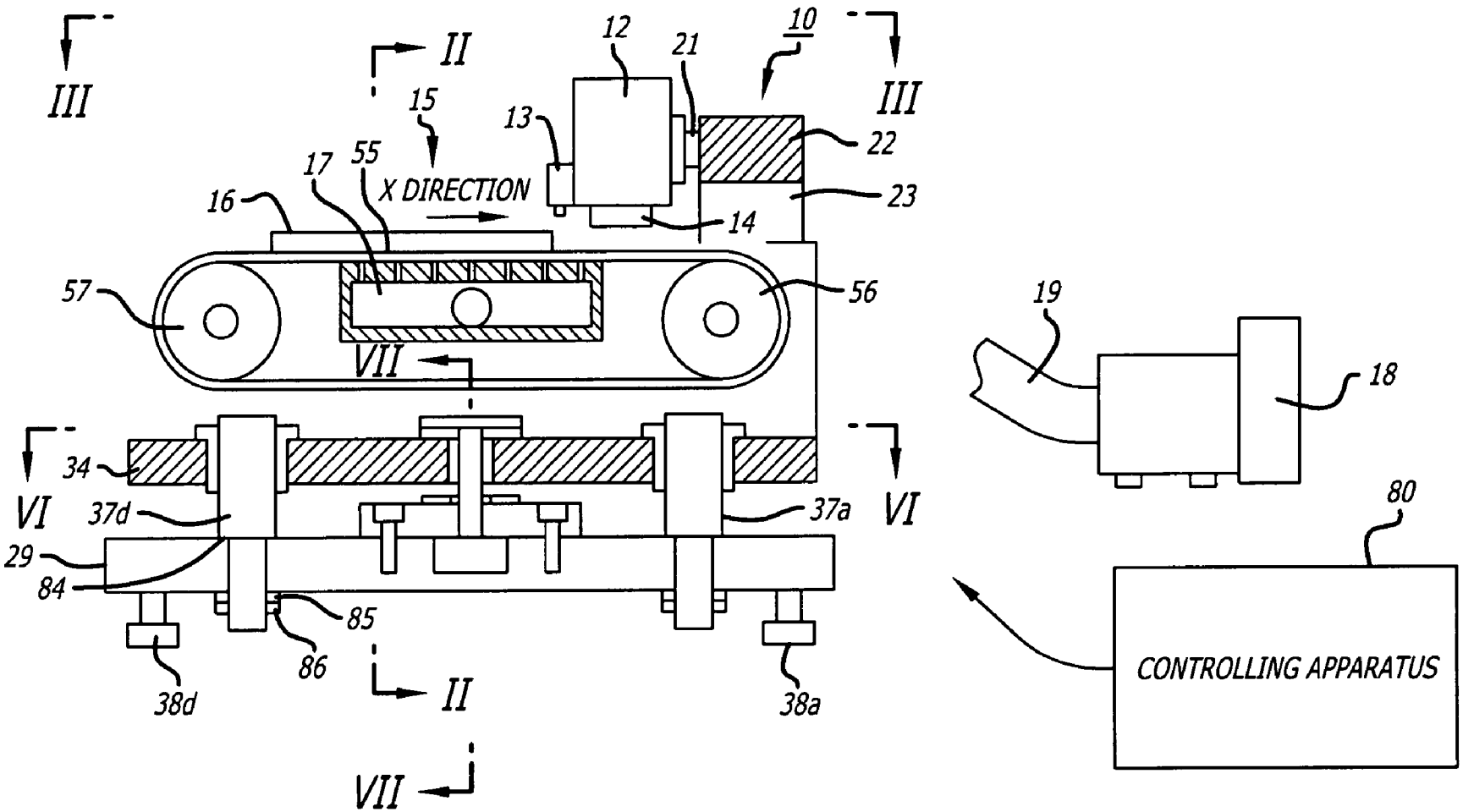
FIG. 1 illustrates a side view of an ink jet printer having a cutting head and a belt conveyor, wherein a frame surrounding the ink jet printer is partially removed, in accordance with one embodiment of the invention.
Figure 2:
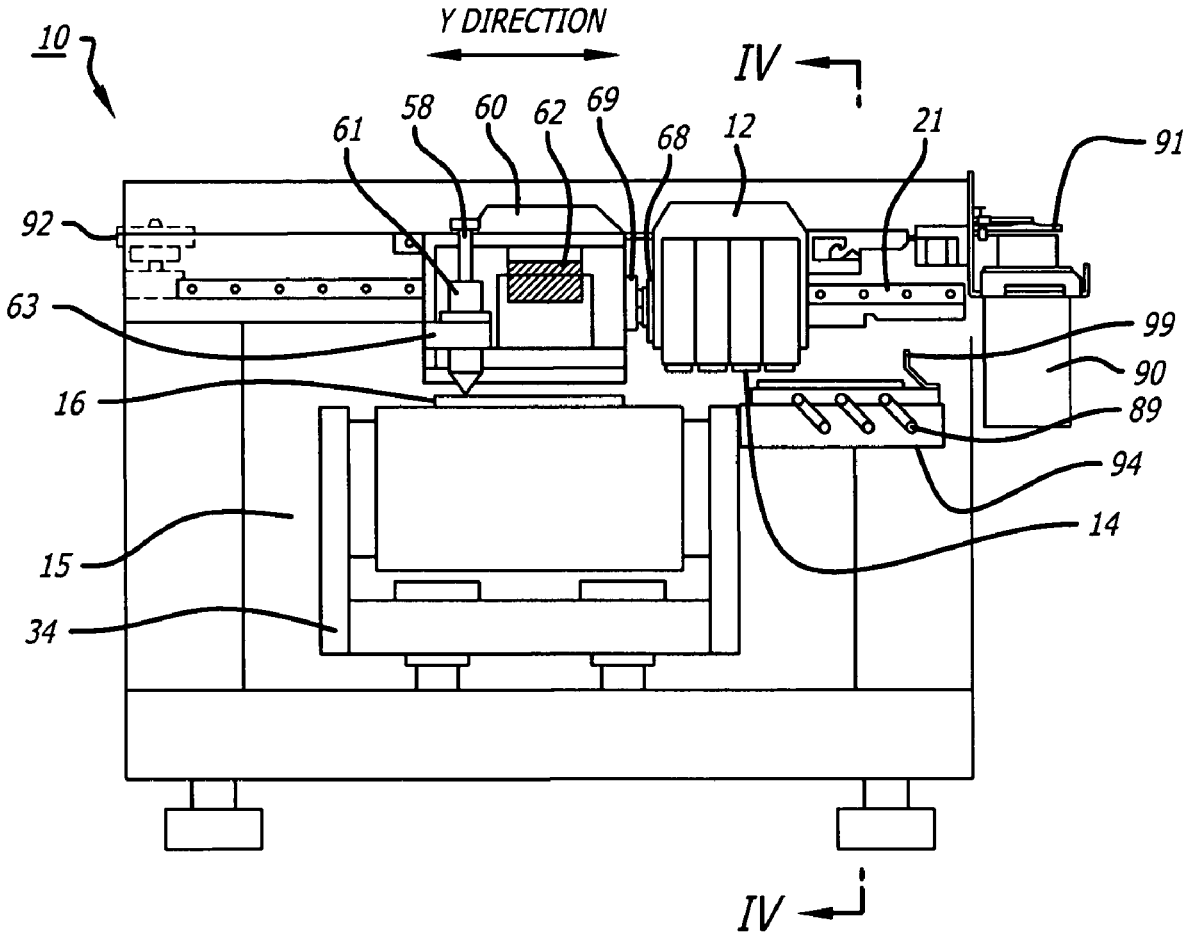
FIG. 2 is a cross section view along II-II in FIG. 1, in accordance with one embodiment of the invention.
Figure 3:
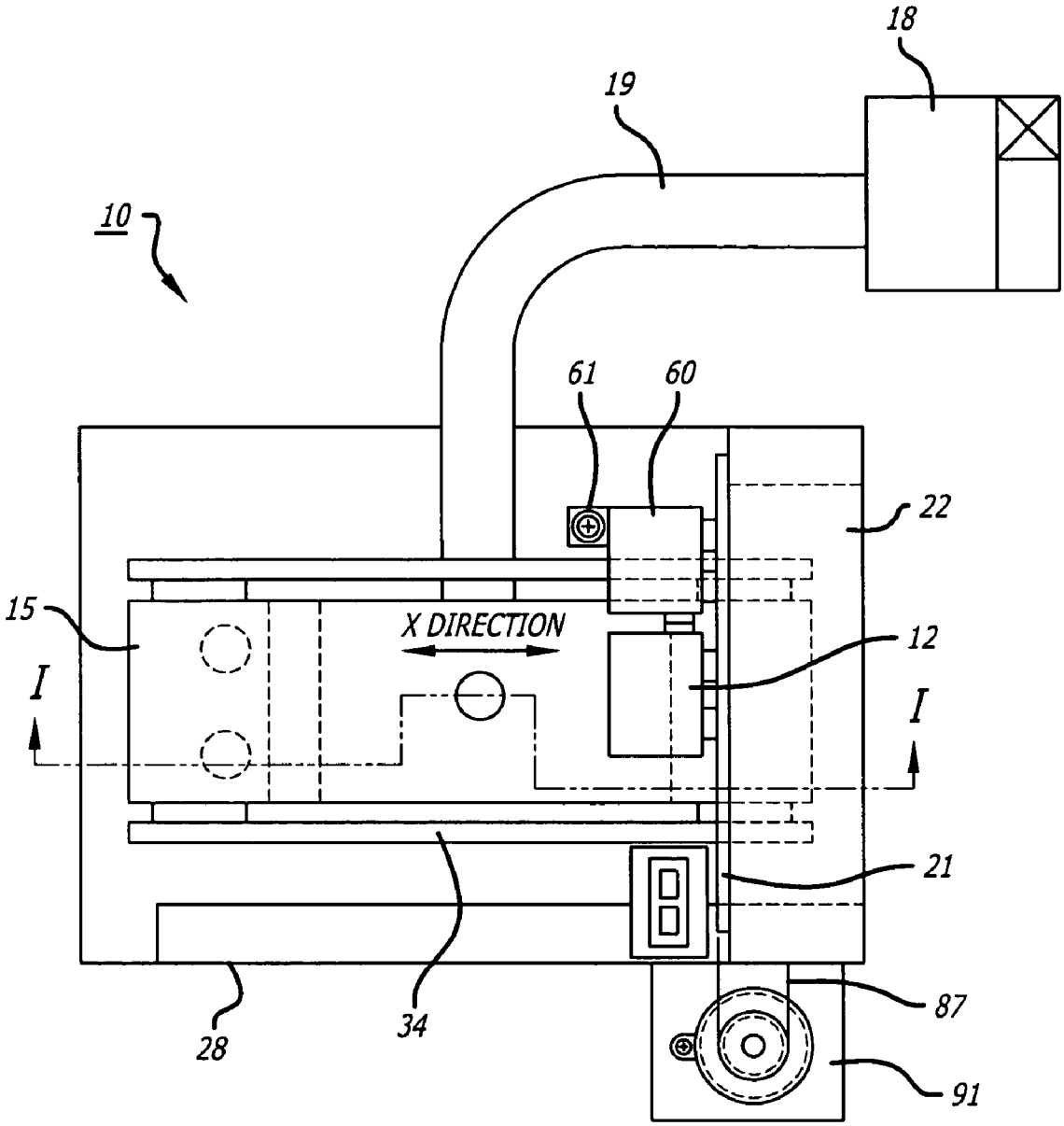
FIG. 3 is a plane view along III-III in FIG. 1, in accordance with one embodiment of the invention.

FIG. 1 illustrates a side view of an ink jet printer having a cutting head and a belt conveyor. FIG. 2 is a cross section view along II-II in FIG. 2. FIG. 3 is a plane view along III-III in FIG. 1. In these figures, a part of a frame surrounding the ink jet printer is omitted. FIG. 1 is a cross section view of I-I in FIG. 3. Referring to FIG. 1, an ink jet printer 10 comprises a cutting head 60 and a belt conveyor 15 for transporting an item to be processed 16. An ink jet head 12 is mounted opposite to the belt conveyor 15. The cutting head 60 connects to the ink jet head 12.

The belt conveyor 15 comprises a belt 55 preferably made of a mesh-like material, a drive pulley 56, and a secondary pulley 57 provided in a direction wherein the item to be processed 16 is transported. Preferably, the item to be processed 16 travels in the X direction. A vacuum unit 17, located between an upper and lower belt of the belt conveyor 15, provides suction for securing the item to be processed 16 on the belt conveyor 15 during transport. An exhaust blower 18 provides suction via a suction duct connected to the vacuum unit 17.

Preferably, the cutting head 60 and the ink jet head 12 are disposed on an upper frame 22 proximal to an intersection of the X and Y direction. The cutting head 60 and the ink jet head 12 move back and forth along a direct acting rail 21 for providing a tracking means. The ink jet head 12 and the cutting head 60 connect separately to the direct acting rail 21 via a direct acting block.

The ink jet head 12 comprises a plurality of color-specific nozzles ejecting ink for printing. Opposite the ink jet head 12 is a sensor 13 installed on a side of a secondary pulley 57 and the belt conveyor 15. The cutting head 60 comprises a cutter 61 for cutting the item to be processed 16 and a solenoid 62 for vertically moving the cutter 61. The cutting head 60 also comprises a cutter holder 63, wherein the cutter 61 is held at a predetermined position.

Preferably, the cutter 61 is raised upwards by a coil spring. In order to cut the item to be processed 16, such as paper, with the cutter 16, the solenoid 62 is activated and the cutter 61 is lowered on a cutting surface by a plunger 58, working against the coil spring.

The cutter 61 may be installed at the predetermined position by a swivel knife method or a rotation method. As such, any cutter known in the art, such as an ultrasound cutter, a heat cutter, or an ordinary cutter may be implemented in the present invention.

Alternatively, the cutter holder 63 may be modified into a pen holder. Thus, upon receiving an image data signal, the pen holder may create an image using an image creation pen held within the pen holder. The image creation pen may be any one of an ink pen, a felt-tip pen, a ballpoint pen, a pencil or the like.

Referring to FIG. 2, the connection between the ink jet head 12 and the cutting head 60 will be described. The ink jet head 12 is located to the right of the cutting head 60 on the direct acting rail 21, wherein the ink jet head 12 and the cutting head 60 removably connect by a magnetic attraction force. Preferably, a first magnet 68 is disposed on a left wall of the ink jet head 12 and a second magnet 69 is disposed on the right wall of the cutting head 60 such that the cutting head 60 and the ink jet head 12 magnetically connect when the first magnet 68 and the second magnet 69 are proximal to one another. In another embodiment, a metal sheet or the like may be used instead of either the first magnet 68 or the second magnet 69 to removably connect the ink jet head 12 to the cutting head 60.

Referring to FIGS. 2 and 3, the cutting head 60 is driven by a wire 87, followed by a movement of the ink jet head 12. One end of the wire 87 is driven via a drive pulley 91 by a motor 90 provided on one end of the upper frame 22 in the ink jet printer 10 having the cutting head 60. A secondary pulley 92 supports the other end of the wire 87. In FIG. 3, the secondary pulley 92 is omitted.

A capping apparatus 94 is provided for performing maintenance of the ink in the in jet nozzle 14 when the ink jet head 12 is not used. Preferably, the maintenance includes measuring a level of ink available for the ink jet nozzle 14. The ink jet head 12 is disconnected from the cutting head 60 upon a user command to cut-out an image of the item to be processed 16. In the cutting mode of the printer, the capping apparatus 94 is used to protect the ink jet head 12.

A procedure for disconnecting the ink jet head 12 and the cutting head 60 will now be described. The cutting head 60 moves the ink jet head 12 to a capping position. In this state, an end of the side of the capping apparatus 94 attached to the ink jet head 12 is locked at a locking part provided at the end of the side of the capping apparatus 94 on the direct acting rail 21. By moving the cutting head 60 with the wire 87 towards the secondary pulley 92, the cutting head 60 separates from the ink jet head 12. To connect the cutting head 60 to the ink jet head 12, the locking part is first unlocked. The second magnet 69 is then connected to the first magnet 68, thus permitting unified movement of the cutting head 60 with the ink jet head 12.

Still referring to FIGS. 2 and 3, the capping apparatus 94 is distally disposed to the belt conveyor 15 so that independent movement of the cutting head 60 is not disturbed. When the ink jet head 12 is held at the capping position, the cutting head 60 moves the ink jet head 12 to come into contact with a stop position 99 provided at the right end of the capping apparatus 94. When the ink jet head 12 reaches the stop position 99, a fitting oscillatingly provided in the capping apparatus 94 vertically stands to cap the ink nozzle 14 in the ink jet head 12.

Figure 4:
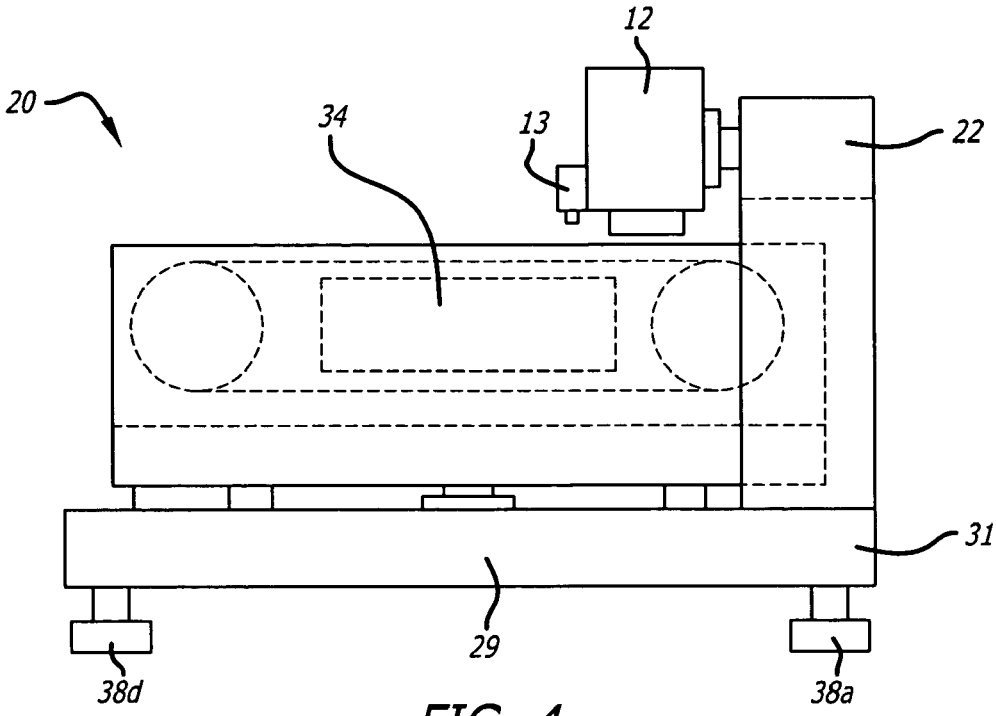
FIG. 4 is a top view of a capping apparatus for the ink jet head, in accordance with one embodiment of the invention.

Referring to FIG. 4, a state wherein the ink nozzle 14 is locked with the capping apparatus 94 at the capping position will be explained. The ink jet head 12, as shown in FIG. 2, has black-ink and color-ink nozzles. Ink head maintenance is performed in a black-ink capping part 95 and a color-ink capping part 96 in each nozzle independently. The black-ink capping part 95 and the color-ink capping part 96 are connected to a pump 98 via separate tubes 97*a* and 97*b*, wherein the pump 98 provides suction for collecting ink expelled from the ink nozzles during maintenance.

A drive pulley 56 and a secondary pulley 57, as shown in FIG. 1, are supported in the belt conveyor 15 by a belt conveyor support frame 34, wherein the drive pulley 56 is driven by a motor.

Figure 5:
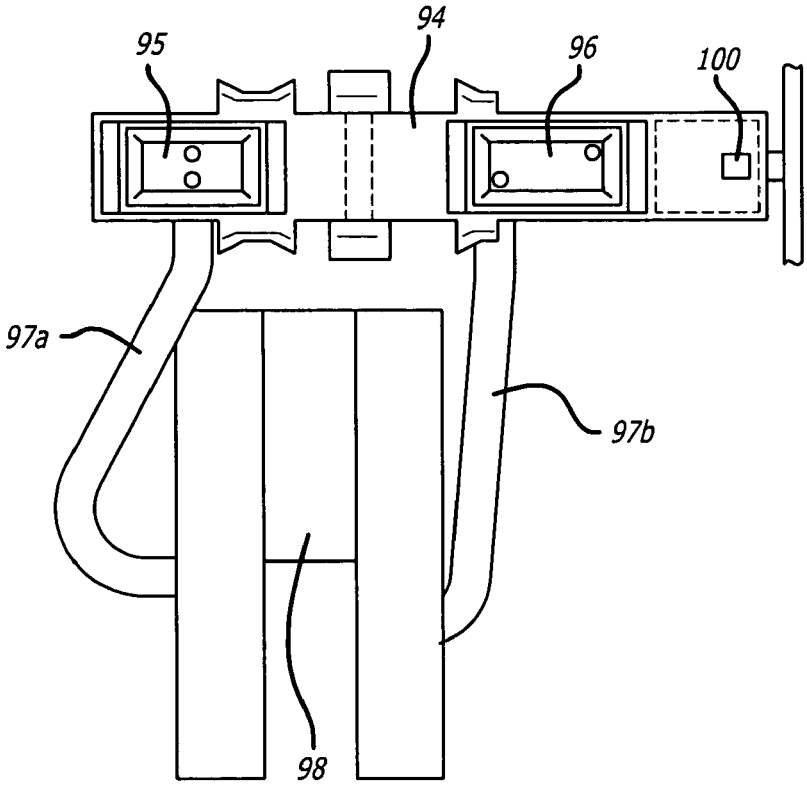
FIG. 5 is a cross section view along IV-IV in FIG. 2, in accordance with one embodiment of the invention.
Figure 6:
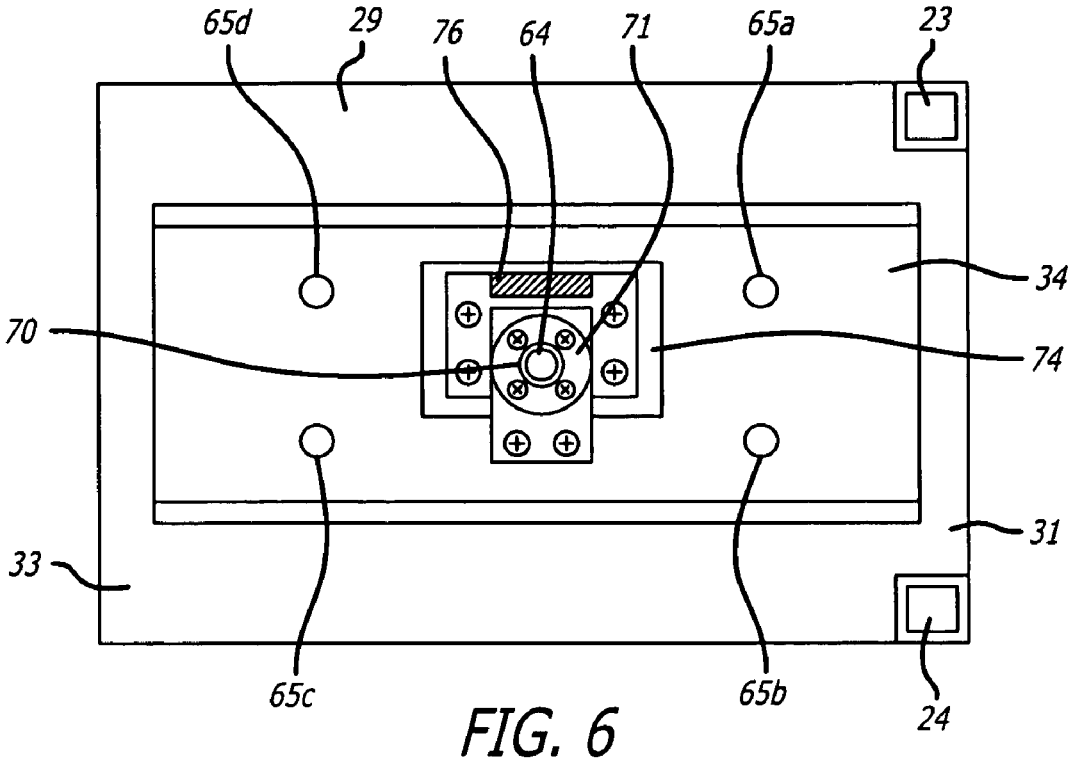
FIG. 6 is a cross section view along VI-VI in FIG. 1, in accordance with one embodiment of the invention.
Figure 7:
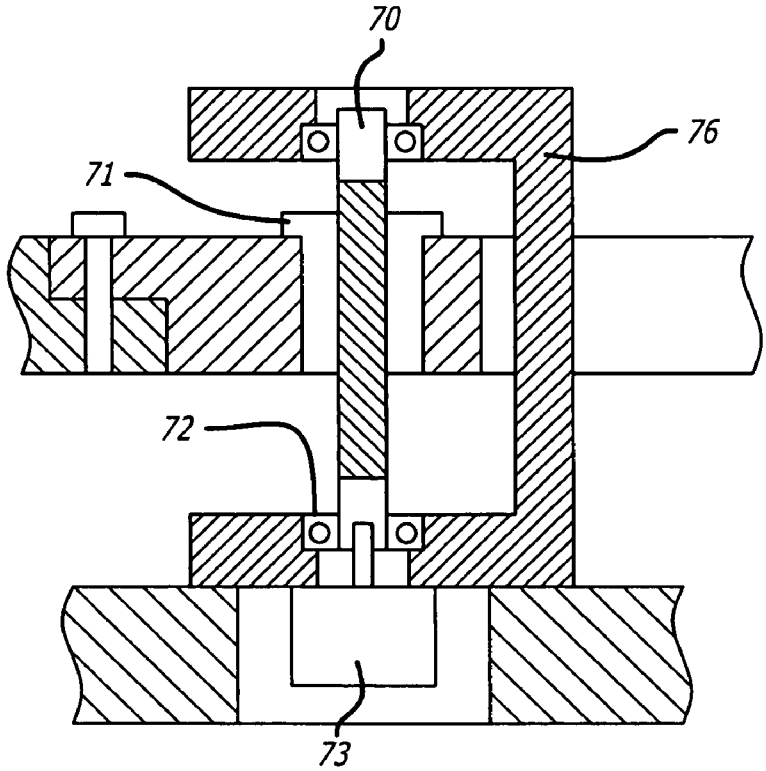
FIG. 7 is a cross section view along VII-VII in FIG. 1, in accordance with one embodiment of the invention.

FIG. 5 is a cross section view along IV-IV in FIG. 2. FIG. 6 is a cross section view of VI-VI in FIG. 1. FIG. 7 is a cross section view along VII-VII in FIG. 1. Referring to FIGS. 1, 5 and 6, a frame 20 of the ink jet printer 10 is disclosed. The frame 20 comprises a lower base 29, an upper frame 22, and first and second columns 23 and 24 for connecting the upper frame 22 to the lower base 29. The upper frame 22 holds the cutting head 60 and the ink jet head 12.

The lower base 29 is preferably integrally formed of a cast or die cast aluminum. Openings 65*a*-65*d* are provided near the corners of the lower base 29 for inserting guide bars 37*a*-37*d*. A step 84 for changing from a wide part to a narrow part is provided in the center of the guide bars 37*a*-37*d*, wherein the narrow part is engaged in the openings 65*a*-65*d*. The lower base 29 is fixed to each of the openings 65*a*-65*d* using a washer 85 and a nut 86. Under the lower base 29, height-adjustable support legs 38*a*-38*d* are provided for leveling the cutting head 60.

Referring to FIGS. 5, 6 and 7, the belt conveyor support frame 34 comprises a block 74 fixed in the center, wherein a ball screw push 71 is affixed with screws. A ball screw shaft 70 is rotationally engaged in the ball screw push 71. A ball screw shaft 70 is rotatably installed in an angular U-shaped member 76 via a bearing. The member 76 is provided with a motor 73 for rotating the ball screw shaft 70. The belt conveyor support frame 34 moves vertically by rotating the ball screw shaft 70 driven by the motor 73. A wide part of the guide bars 37*a*-37*d* slidably insert into a ball push bearing compressed into the guide holes 65*a*-65*d* so that the belt conveyor support frame 34 is elevated perpendicular to the ink jet head 12.

Referring to FIGS. 1-4, an operation of the ink jet printer 10 in accordance with one embodiment of the invention will be explained. The item to be processed 16 is provided on the belt conveyor 15. The belt conveyor 14 transports the item to be processed 16 to the cutting head 60 and the ink jet head 12. The sensor 13, on the ink jet head 12, then detects a shape of the item to be processed 16. For example, the shape of the item may be concave or convex. A controlling apparatus 80 receives information on the detected shape from the sensor 13. In response to the detected shape, the controlling apparatus 80 adjusts a distance between the ink jet nozzle 14 and the item to be processed 16 to an optimal distance by rotating the ball screw shaft 70 with the motor 73. The ink jet head 12 moves with the cutting head 60 as described above.

If the item to be processed 16 is a fabric material, such as cloth or the like, an exhaust blower 18 is activated. The exhaust blower 18 provides suction to the fabric material via a vacuum unit 17 to smooth a surface of the fabric material. Preferably, an optimal distance between the ink jet head 12 and the fabric material is within the range of approximately 2 mm to 5 mm. However, the optimal distance varies dependent on the item to be processed 16.

Upon printing completion by the ink jet head 12 on the item to be processed 16, the cutting head 60 transports the ink jet head 12 to the position of the capping apparatus 94, as described above, to release the ink jet head 12. The cutting head 60 independently cuts the image printed by the ink jet head 12. Alternatively, the ink jet head 12 may also print a predetermined cutting line on the item to be processed 16 for guiding the cutting head 60.

Because the item to be processed 16 is transported by the belt conveyor 15, the ink jet printer 10 is capable of printing when the item to be processed 16 has a metal surface, such as a steel plate. Furthermore, the ink jet printer 10 may engrave an item to be processed such as a stone having a concave or convex surface.

When the cutting head 60 is used for cutting, the ink jet head 12 is not required to move; thus, the wire 87, the ink tubes 97*a*, 97*b*, a cable, not shown, or the like connected to the ink jet head 12 do not become damaged or deteriorated. Consequently, the ink jet head 12 and accompanying hardware realizes a longer service life.

Also, a belt of the belt conveyor 15 is meshed to print on a fabric product; however, the belt is not limited to a mesh construction. To transport an item to be processed 16 that is heavy, a solid belt having a strength suitable to the weight thereof is utilized.

Figure 8:
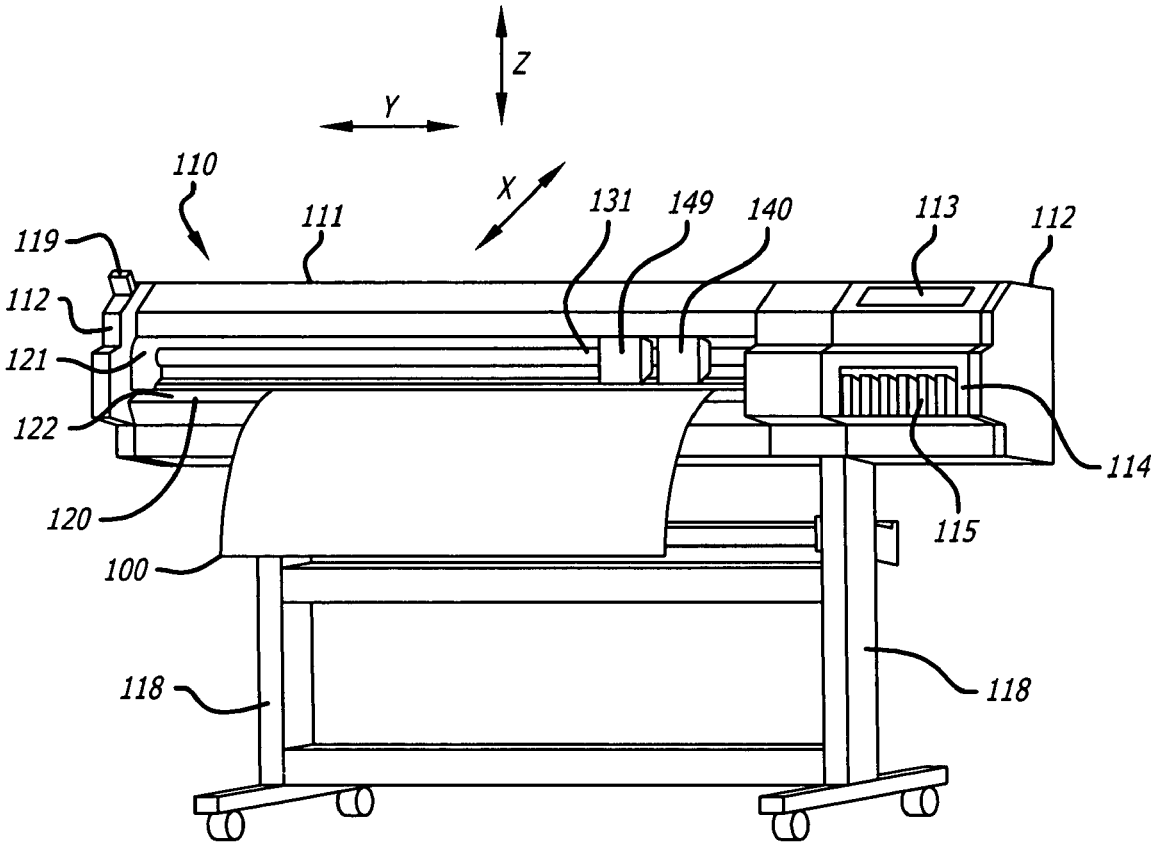
FIG. 8 illustrates an image creation and cutting apparatus, in accordance with one embodiment of the invention.

Referring to FIG. 8, an image creation and cutting apparatus 110 (hereinafter referred to as "printer 110") in accordance with another embodiment of the invention will be described. In this embodiment, a sheet 100 such as a single sheet or a coiled long sheet is used. Scanning performed in a direction of a width of the sheet 100 which is hereinafter referred to as a "primary scanning direction". Scanning performed in a direction perpendicular to the primary scanning direction (i.e., both a longitudinal direction and a moving direction of the sheet) is hereinafter referred to as a "secondary scanning direction."

Preferably, the primary scanning direction is provided to align along a Y-axis of an X, Y, and Z coordinate system. The secondary scanning direction is provided to align along an X-axis. The printer 110 prints an image on paper and an outline thereof is cut using a cutter provided at the cutting head 149. Preferably, printing and cutting functions are based on instruction(s) from a personal computer (PC) or the like.

A main body 111 of the printer 110 comprises a base member 120 of a fixed system set that extends in the primary scanning direction and a stand 118 for supporting the base member 120. The main body 111 further comprises a cutting head 149 having an ink jet head 140 for providing ink for printing an image and a cutter 151, shown in FIGS. 9A-9C, for cutting the image. A direct acting rail 131 works as a guide to move the ink jet head 140 along the primary scanning direction. An operation panel 113 is provided at one end of the main body 111. An ink cartridge supply holder 114 stores an ink cartridge 115. A side cover 112 is provided at both ends of the main body 111. The operation panel 113 displays the printer 110 operation status, assigns, through a cursor key, a location of the ink jet head 140 and the cutting head 149, and assigns, using a starting area setting key, a predetermined location on the sheet 100 to start creating or cutting an image based on an image data signal. A start operation key is further provided to start creating or cutting the image from the start area on the sheet 100.

The main body 111 further comprises a front cover 121 at a front side and a platen 122 under the ink jet head 140 and the cutting head 149. A pinch roll lever 119 is provided at a left end of the main body 111 for holding paper with a pinch roll in the platen 122 for printing using the ink jet head 140 and cutting using the cutting head 149.

Figure 9A:
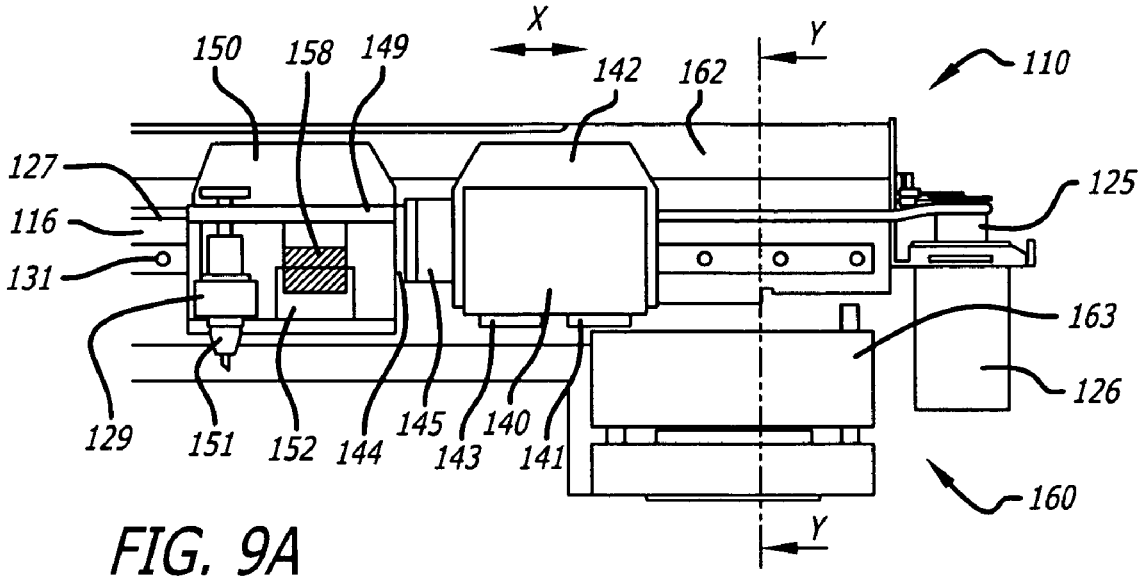
FIGS. 9A, 9B, and 9C illustrate a connection between a cutting head and an ink jet head at various locations on a guide rail, in accordance with one embodiment of the invention.
Figure 9B:
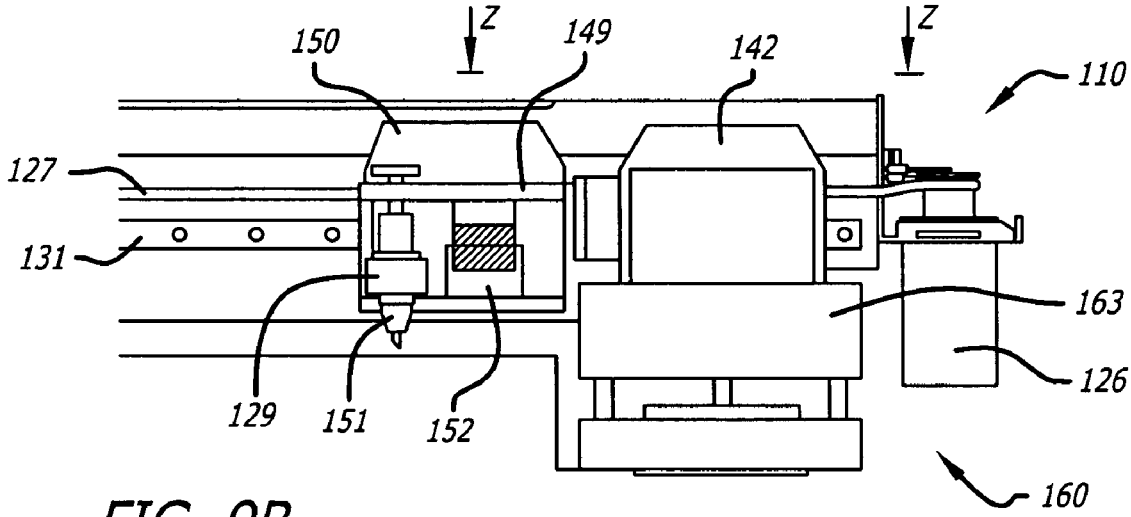
Figure 9C:
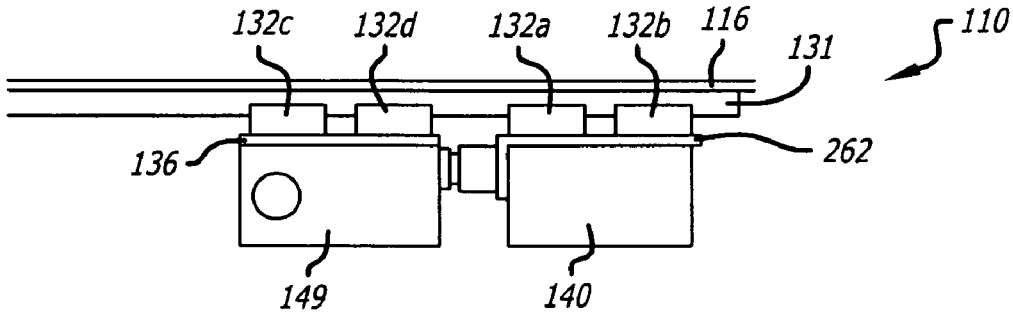

FIGS. 9A, 9B, and 9C illustrate a connection between the cutting head and the ink jet head at various locations on the guide rail. Referring to FIGS. 9A-9C, an operation of the ink jet head 40 and the cutting head 149 will be described.

The ink jet head 140 is held in an ink jet head carriage 142, while the cutting head 149 is held in a cutting head carriage 150. The ink jet head carriage 142 and the cutting head carriage 150 are interconnected so that a motor 126 can drive them on a direct acting rail 131 along the primary scanning direction through a wire 127. The sheet 100, driven by a pinch roller, is pushed toward the secondary scanning direction. The ink jet head 140 comprises ink jet nozzles 141 and 143. Preferably, the ink jet nozzles 141 and 143 eject colors such as yellow (Y), magenta (M), cyan (C), and black (K), respectively.

The cutting head 149 comprises a cutter holder 129 and a cutter 151. The cutter 151 is held at a predetermined location within the cutter holder 129. Preferably, the cutter 151 is raised upwards by a coil spring. In order to cut the sheet 100 with the cutter 151, a solenoid 152 provided at the cutting head 149 activates a plunger to move against the coil spring, thereby lowering the cutter 151 on a cutting face of the sheet 100. The cutter 151 may be installed at a predetermined installation part by swivel knife method or rotation method. The cutter 151 may be any one of a knife, ultrasonic cutter, heat cutter, or the like.

Alternatively, the cutter holder 129 may be modified into a pen holder. Thus, upon receiving an image data signal, the pen holder may create an image using an image creation pen held within the pen holder. The image creation pen may be any one of an ink pen, a felt-tip pen, a ballpoint pen, a pencil or the like.

A connection part for removably connecting the ink jet head carriage 142 to the cutting head carriage 150 will now be described. A magnetic attraction force may removably connect the ink jet head carriage 142 and the cutting head carriage 150. The ink jet head carriage 142 is provided to the right of the cutting head carriage 150 on the direct acting rail 131. Preferably, a first magnet 144 provided at a right side of the cutting carriage 150 is connected to a first connection and a second magnet 145 disposed on a left side of the ink jet head carriage 142 is also connected to the first connection. Thus, the ink jet head carriage 142 and the cutting head carriage magnetically connect at the first connection. In another embodiment, a combination of a magnet and a metal sheet or the like may be used for connecting the cutting carriage 150 and the ink jet head carriage 142 in place of the first and second magnets 144, 145.

The ink jet head carriage 142 and the cutting head carriage 150 may be connected or separated. The cutting head 150 is driven by the wire 127, followed by the movement of the ink jet head carriage 142.

FIG. 9C is a plane view along Z-Z in FIG. 9B. As shown in FIG. 9C, the ink jet head carriage 142 is preferably set at an ink jet head installation position 262 on the direct acting rail 131 via direct acting blocks 132*a*, 132*b*. Similarly, the cutting head 150 is installed at a cutting head installation position 136 on the direct acting rail 131 via direct acting blocks 132*c* and 132*d*. Below the direct acting guide 130 will be explained.

Figure 10A:
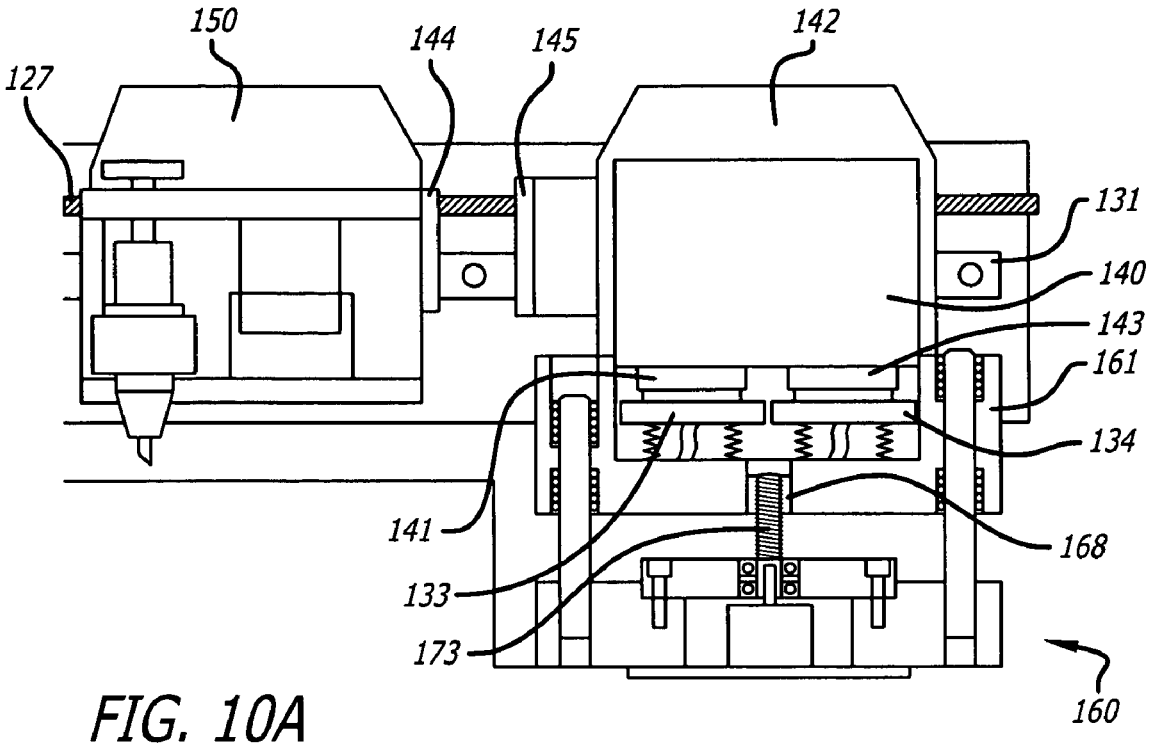
FIGS. 10A and 10B are partial cross section views of a capping apparatus for preventing the ink jet head from drying out, in accordance with one embodiment of the invention.
Figure 10B:
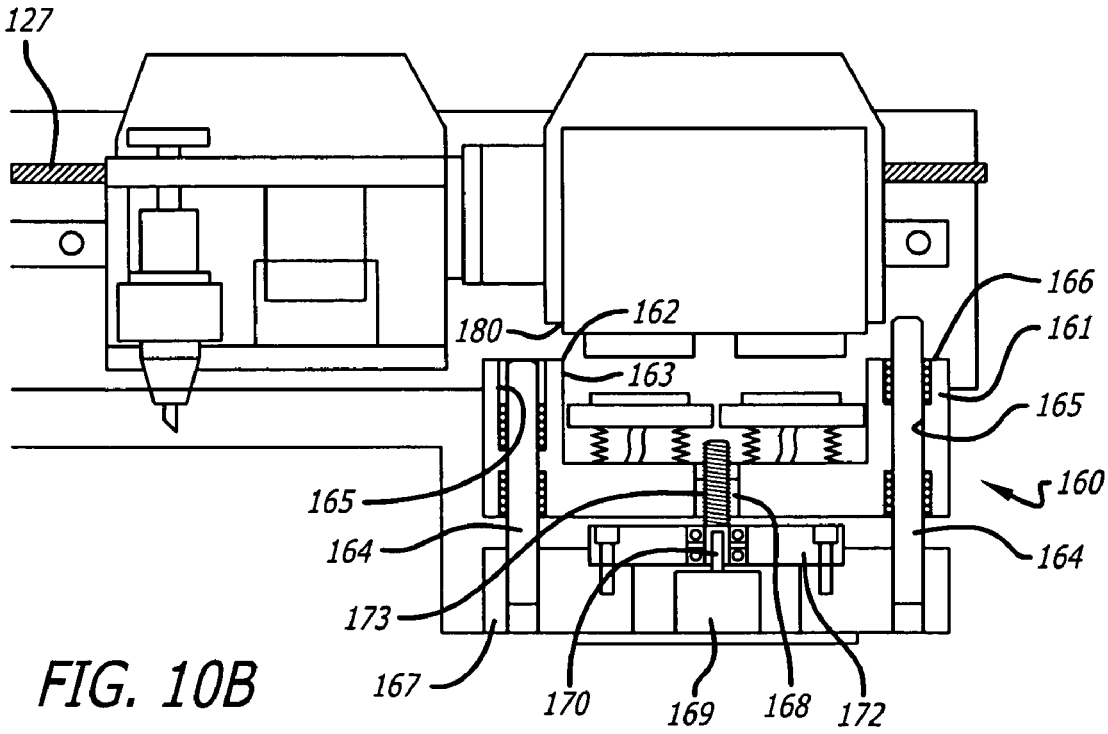
Figure 11A:
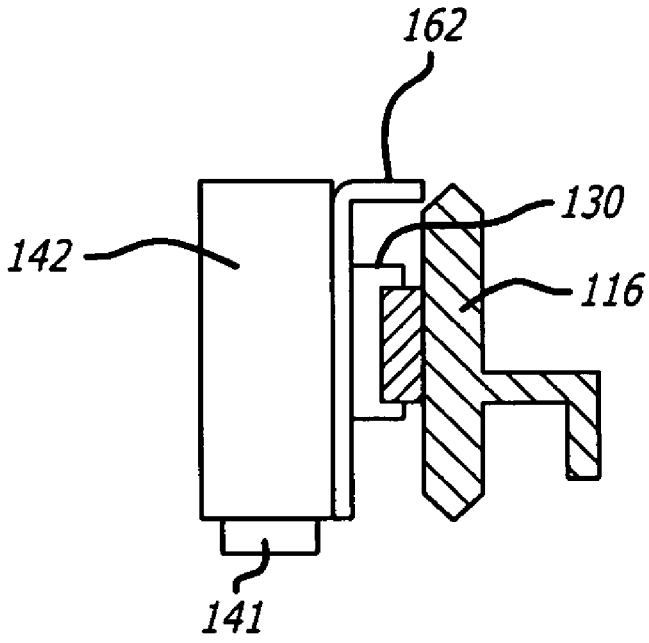
FIGS. 11A and 11B are a side view and a top view, respectively, of a direct acting guide, in accordance with one embodiment of the invention.
Figure 11B:
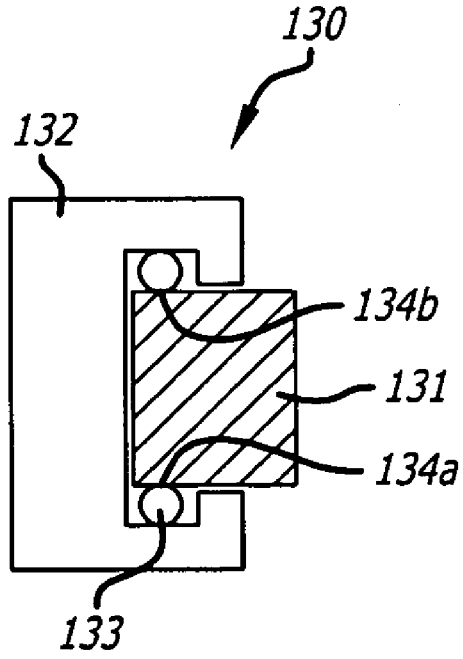

Referring to FIGS. 10A-10B and 11A-11B, wherein FIG. 11A is a cross section view along Y-Y in FIG. 9A, a direct acting guide 130 will be explained. The direct acting guide 130 is installed in the guide rail 116 and comprises a direct acting block 132 which slides on the direct acting rail 131. The direct acting block 132 comprises the ink jet head installation position 262 and the cutting head installation position 136. Rollable members 134*a*, 134*b* are provided between the direct acting block 132 and the direct acting rail 131 for smoothly sliding the direct acting block 132 with high precision on the direct acting rail 131. Preferably, a plurality of balls 133 rotate inside the members 134*a*, 134*b* on the direct acting block 131 to create the smooth sliding motion of the direct acting block 132.

Referring to FIGS. 10A, 10B, the capping state of the ink jet nozzles 141,143 engaged in the capping apparatus 160 will be described. When the ink jet head carriage 142 reaches the capping position located at a right edge by the cutting head carriage 150, a capping holder 161 installed in the capping apparatus 160 slides freely along the Z direction. Thus, the capping holder 161 moves vertically upwards to thereby cap the ink jet nozzles 141, 143 of the ink jet head 140.

Figure 12:
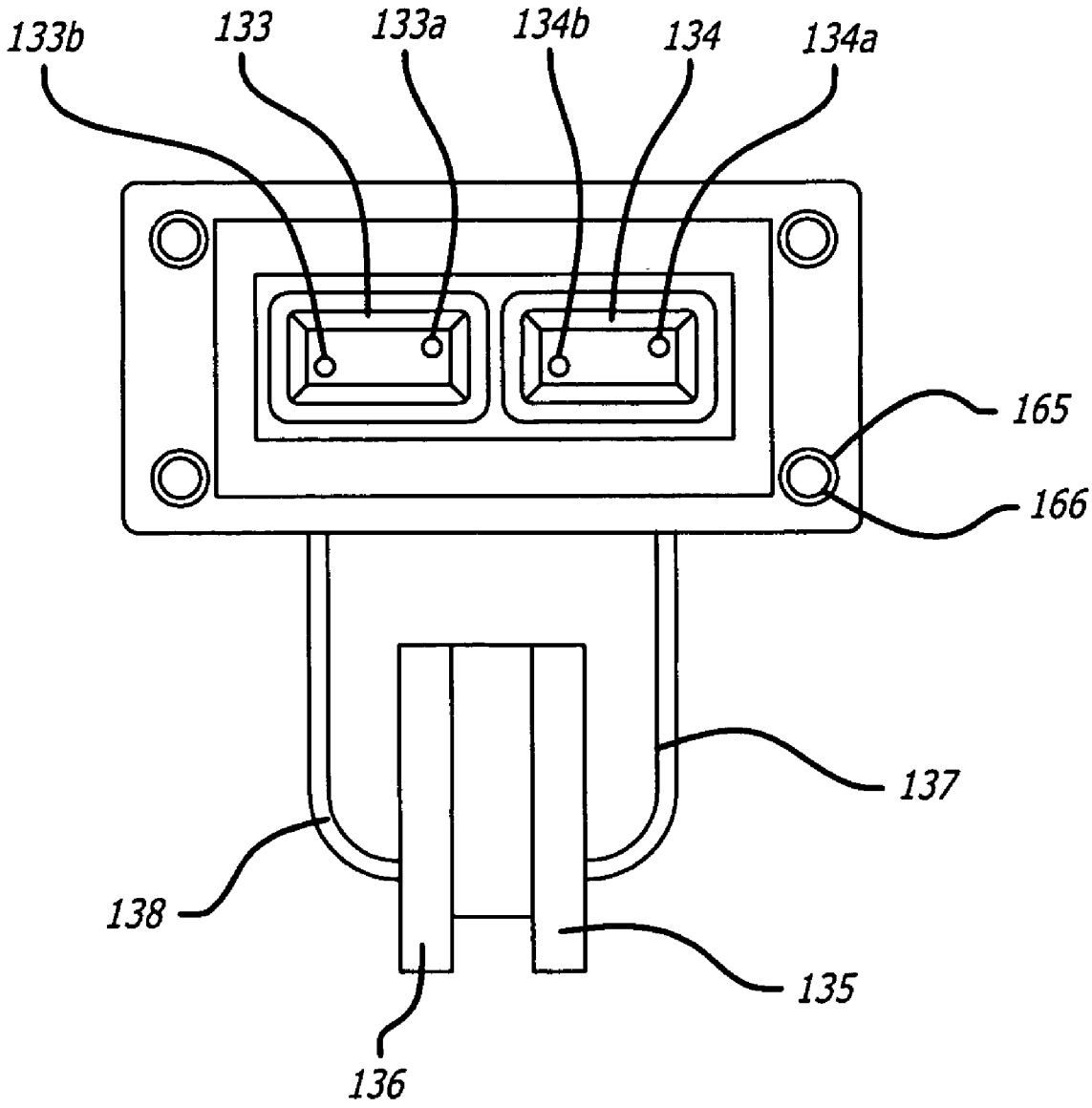
FIG. 12 is a top view of the capping apparatus, in accordance with one embodiment of the invention.

Referring to FIG. 12, capping members 133, 134 covering the ink jet nozzles 141, 143, as shown in FIG. 10A, have suction holes 133*a*, 134*a* connected to one end of tubes 137, 138. The tubes 137, 138 comprise pumps 135, 136, respectively, so as to receive a suction force. The capping members 133, 134 are biased in an upward position by a spring, thereby sealing surfaces of the ink jet nozzles 141, 143. An edge 162 of a slider 161 (also referred to as the "capping holder 161") wherein the capping members 133, 134 are stored, has a locking part 163 for engaging with the ink jet head 140 for regulating the movement of the ink jet carriage 142.

The slider 161 has a guide hole 165 along four directions for sliding towards the Z direction along a shaft 164. The guide hole 165 is fitted with a push 166. The slider 161 has a screw nut 168 fixed at the center. A slider base 167 located at a lower part of the slider 161 comprises the shaft 164 locked at a location corresponding to the push 166. A shaft 170 of a motor 169 is fixed at an approximate center of the slider base 167 having a Z screw 173 rotatably fixed via a bearing housing 172. The Z screw 173 is rotatably engaged in the screw nut 68. As shown in FIGS. 9A and 9B, at an edge of a drive side of the printer 110, a wire 127 wrapped around a pulley 125 connected to a motor 126 is driven. The wire 127 is connected to the cutting head carriage 150, thereby moving the ink jet head 142 connected to the cutting head carriage 150, in the primary scanning direction.

A method for fixing the ink jet head 140 to the capping position in the ink jet nozzles 141, 143 will now be described. Upon connection of the ink jet head carriage 142 to the cutting head carriage 150, the carriages 142, 150 stop moving upon reaching the edge of the drive side 162, i.e. the capping position, as illustrated in FIG. 10B. The slider 161 is raised by rotating the motor with the Z screw 173, wherein the capping members 133, 134 come into contact with the ink jet nozzles 141, 143 and the edge 162 of the slider 161 simultaneously becomes engaged within a convex portion 180 of the ink jet head 140. Thereby, the ink jet head carriage 142 becomes fixed at the capping position.

Figure 13:
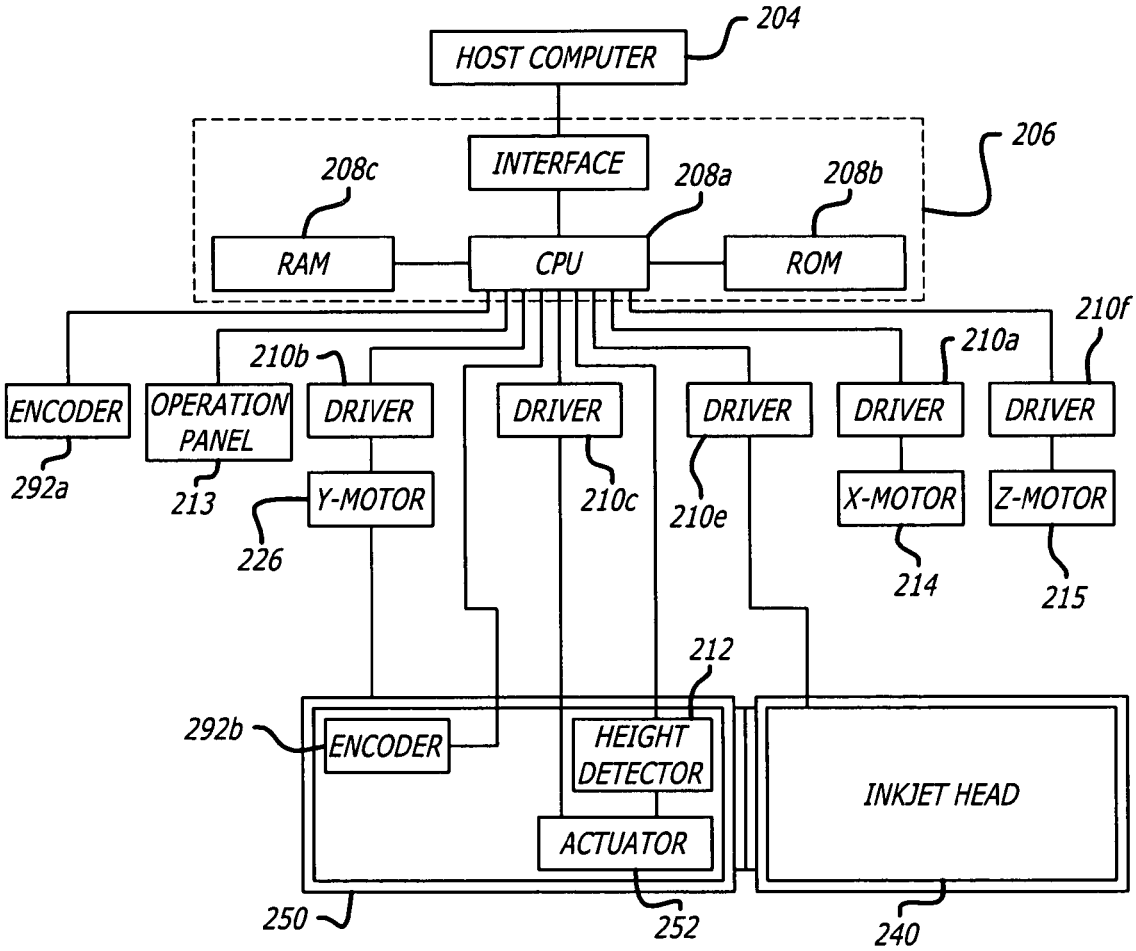
FIG. 13 is block diagram illustrating a method for controlling printing and cutting functionality, in accordance with one embodiment of the invention.

FIG. 13 is block diagram illustrating a method for controlling printing and cutting functionality, in accordance with one embodiment of the invention. A microcomputer 206 comprises a CPU 208*a*, a ROM 208*b* wherein a program to be executed by the CPU 208*a* is stored, and a RAM 208*c* functioning as a working area wherein a buffer memory is set for temporarily storing a data signal from a host computer 204 as well as a variety of registers necessary for the CPU 208*a* to execute a program.

The CPU 208*a* is connected to drivers 210*a*, 210*b*, 210*c* for switching on and off an X motor 214, a Y motor 226, and a Z motor 215, and an actuator 252 via a bus. A driver 210*e* is connected to the CPU 208*a* for controlling the inkjet head 240. A driver 210*f* is connected to the CPU 208*a* for controlling the Z motor 215 to raise and lower the slider 261. An operation panel 213, wherein a power switch and a variety of operation keys are installed, is also connected to the CPU 208*a*.

In one embodiment of the present invention, the X motor 214, the Y motor 226, and the actuator 252 may be a stepping motor. However, in a different embodiment, the stepping motor may be replaced with a servo motor. As such, the X motor 214, the Y motor 226, and the actuator 252 are connected to encoders 292*a*, 292*b* and a height detector 212, respectively, for detecting the state of the X motor 214, the Y motor 226, and the actuator 252. A position of the cutting carriage 150 for the sheet 100 is stored and loaded into the RAM 108*c* via the CPU 208*a*. The encoders 292*a*, 292*b* and a height detector 212 may detect the state of the X motor 214, the Y motor 226, and the actuator 252 at all times regardless of whether the X motor 280, the Y motor 282, or the actuator 252 is turned on or off.

A method for cutting involves the ink jet head carriage 142 located at the capping position to move the cutting carriage 150 to a left side. Since the ink jet carriage 142 locked at the edge 162 is prevented from moving, the magnetic attraction is released between the ink jet head carriage 142 and the cutting carriage 150. Thus, only the cutting carriage 150 is allowed to move in the primary scanning direction. When the CPU 208*b* requests cutting data from the RAM 208*c*, a data sequence read from the cutting data controls the driver to actuate the X motor 214, the Y motor 226, and the actuator 252. The sheet 100 is then cut using the cutter 151 positioned in the cutting carriage 150.

A method for printing involves attracting the magnets 144, 145 and connecting the inkjet carriage 142, wherein the inkjet head 140 is installed, to the cutting carriage 150, wherein the cutting head 149 is installed. To create an image on the sheet 100, an image data signal output from the host computer 204 in the buffer memory is loaded and stored in the RAM 208*c*. The CPU 208*a* then reads the image data from the RAM 208*c* according to a read sequence. The X motor 214, the Y motor 226, and the actuator 252 are controlled by the drivers 210*a*, 210*b*, 210*c*, and 210*e* in accordance with the image data. The desired image is then created on the surface of the sheet 100 with ink ejected from the ink jet nozzles installed in the ink jet head 140.

Although the present invention is described in the context of an ink jet printer, the present invention may also be used in any printer or printing system. Moreover, the use of certain terms to describe the present invention should not limit the scope of the present invention to a certain type of printer.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A printer for cutting-out a printed image on a medium to be processed that is located on a surface traveling in a first direction, the printer comprising:

a cutting head coupled for movement in a second direction;

an ink head detachably coupled to the cutting head for movement in the second direction;

a capping apparatus for protecting the ink head; and a fixed base for supporting the surface, wherein the first direction is perpendicular to the second direction, the cutting head and the ink head are connected separately to a direct acting rail via a direct acting block and move back and forth along the direct acting rail, the cutting head is driven by a wire followed by a movement of the ink head, the cutting head comprising a cutter independently cuts the image printed by the ink head, and the ink head is prevented from moving along the direct acting rail when a portion of the capping apparatus engages a side portion of the ink head to lock the ink head and allow the cutting head to detach from the ink head and move along the direct acting rail without the ink head.

2. The printer of claim 1, wherein the cutting head and the ink head are disconnectably mounted and, upon the cutting head being activated, the ink head is disconnected.

3. The printer of claim 1, wherein when the cutting head and the ink head are disconnectably mounted and, upon the ink head being activated, the cutting head is disconnected.

4. The printer of claim 1, wherein the capping apparatus caps at least one ink nozzle of the ink head when the ink head is not in use.

5. The printer of claim 1, wherein the ink head prints a predetermined cutting line on the medium to be processed for guiding the cutting head.

6. A printer for cutting-out a printed image on a medium to be processed that is located on a surface traveling in a first direction, the printer comprising:

a conveyor for transporting a medium to be processed along a first direction;

an ink head having at least one ink nozzle, the ink head disposed for movement in a second direction perpendicular to the first direction;

a cutting head detachably coupled to the ink head and independently cutting the image printed by the ink head;

a sensor for detecting a shape of the medium to be processed and a distance of the medium to be processed from the at least one ink nozzle and the cutting head during transportation by the conveyor; and a capping apparatus for protecting the ink head, wherein the ink head is prevented from moving along the second direction when a portion of the capping apparatus engages a side portion of the ink head to lock the ink head and allow the cutting head to detach from the ink head and move along the second direction without the ink head.

7. The printer of claim 6, wherein the conveyor comprises a belt conveyor.

8. The printer of claim 6, wherein the conveyor is supported by a conveyor support base for supplying the medium to the at least one ink nozzle for printing an image on the medium to be processed through the ink head.

9. The printer of claim 8, further comprising means for vertically moving the conveyor support in response to the distance detected by the sensor.

10. The printer of claim 8, wherein when the ink head is printing the image, the cutting head is disconnected from the ink head.

11. The printer of claim 8, further comprising means for providing a vacuum to an undersurface of the medium to be processed for securing the medium to the conveyor.

12. The printer of claim 9, wherein the means for vertically moving the conveyor support utilizes a ball screw push within a ball screw shaft apparatus.

13. The printer of claim 9, further comprising means for providing a vacuum to an undersurface of the medium to be processed for securing the medium to the conveyor.

14. The printer of claim 6, wherein the cutting head moves the ink head.

15. The printer of claim 6, wherein the cutting head and the ink head are disconnectably mounted and, upon the cutting head being activated, the ink head is disconnected.

16. The printer of claim 6, further comprising means for providing a vacuum to an undersurface of the medium to be processed for securing the medium to the conveyor.

17. The printer of claim 6, wherein the capping apparatus caps the at least one ink nozzle of the ink head when the ink head is not in use.

18. The apparatus of claim 6, wherein the sensor is located on the ink head.

19. An apparatus for creating an image on a sheet, the apparatus comprising:

means for moving the sheet in a first direction;

a cutting head, which is held in a cutting head carriage and having a cutter supported for movement on a guide rail positioned in a second direction for cutting the image from the sheet;

an ink head, which is held in an ink head carriage and disposed on the guide rail and detachably positioned on a side of the cutting head for creating the image on the sheet;

means for controlling movement of the cutting head and the ink head on the guide rail in response to image data;

a direct acting guide, which is installed in the guide rail and comprises a direct acting block which slides on a direct acting rail;

a capping apparatus for protecting the ink head;

a first connection means disposed on a side of the cutting head; and a second connection means disposed on a side of the ink head for detachably coupling with the first connection means, wherein the first and second directions are an X direction and a Y direction, respectively, in an X, Y, and Z coordinate system and substantially perpendicular, and the ink head carriage and the cutting head carriage are interconnected and driven by a motor on the direct acting rail along the second direction through a wire connected to the cutting head carriage, and the ink head is prevented from moving along the guide rail when an edge of the capping apparatus engages a side portion of the ink head to lock the ink head and allow the cutting head to detach from the ink head and move along the guide rail without the ink head.

20. The apparatus of claim 19, wherein the ink head is unlocked to create the image in response to the image data when the edge of the capping holder disengages from the side portion of the ink head.

21. The apparatus of claim 20, further comprising means for controlling the cutting head and the ink head for connecting and disconnecting from one another.

22. The apparatus of claim 19, wherein the ink head and the cutting head are moved integrally on the guide rail located in the Y direction in response to the image data utilized to create the image.

23. The apparatus of claim 22, wherein the cutting head cuts the image in response to the image data.

24. The apparatus of claim 23, wherein the ink head is separated from the cutting head by separating the first connection means from the second connection means.

25. The apparatus of claim 23, wherein at least one of the first and the second connection means comprises a magnetic means.

26. The apparatus of claim 19, wherein the controlling means moves the cutting head on the guide rail in the Y direction based on the image data so that the image is cut on the sheet.

27. The apparatus in claim 19, wherein the capping apparatus performs maintenance of the ink head.

28. The apparatus of claim 19, wherein the capping apparatus caps at least one ink nozzle of the ink head when the ink head is not in use.

29. An apparatus for creating an image on a sheet, the apparatus comprising:

means for moving the sheet in a first direction;

a cutting head, which is held in a cutting head carriage and having a cutter supported for movement on a guide rail positioned in a second direction for cutting the image from the sheet;

an ink head, which is held in an ink head carriage and disposed on the guide rail and detachably positioned on a side of the cutting head for creating the image on the sheet;

means for controlling movement of the cutting head and the ink head on the guide rail in response to image data;

a direct acting guide, which is installed in the guide rail and comprises a direct acting block which slides on a direct acting rail;

a capping holder movable in a third direction, the capping holder holding at least one capping member for capping at least one ink jet nozzle of the ink head;

a first connection means disposed on a side of the cutting head; and a second connection means disposed on a side of the ink head for detachably coupling with the first connection means, wherein the firs, second and third directions are an X direction, a between, Y direction and a Z direction, respectively, in an X, Y, and Z coordinate system and are substantially perpendicular to each other, the ink head carriage and the cutting head carriage are interconnected and driven by a motor on the direct acting rail along the second direction through a wire connected to the cutting head carriage, and the ink head is prevented from moving along the guide rail when an edge of the capping holder engages a side portion of the ink head to lock the ink head and allow the cutting head to detach from the ink head and move along the guide rail without the ink head.

* * * * *